United States Patent [19]

Smith

[11] 4,263,946

[45] Apr. 28, 1981

[54] FILLING HEAD ASSEMBLY FOR DISPENSING LIQUID

[75] Inventor: Douglas J. B. Smith, Stockton on Tees, England

[73] Assignee: Cargo Fleet Chemical Co., Ltd., England

[21] Appl. No.: 64,827

[22] Filed: Aug. 8, 1979

[51] Int. Cl.[3] ..... B65B 3/18; B67C 3/02

[52] U.S. Cl. ..... 141/117; 141/293

[58] Field of Search ..... 141/285-310, 141/59, 117, 116, 4-7, 198, 192, 115, 392, 250-284, 351, 39-43; 222/108-111; 137/387, 388

[56] References Cited

U.S. PATENT DOCUMENTS

| | | | |
|---|---|---|---|
| 2,721,021 | 10/1955 | Day et al. | 141/294 |
| 2,954,806 | 10/1960 | Kerr | 141/275 |
| 3,419,054 | 12/1968 | Tashiro | 141/302 |
| 3,537,267 | 9/1970 | Moore | 141/40 |
| 3,871,425 | 3/1975 | Fee et al. | 141/117 |

FOREIGN PATENT DOCUMENTS 680768 10/1952 United Kingdom .

*Primary Examiner*—Houston S. Bell, Jr.
*Attorney, Agent, or Firm*—Harrington A. Lackey

[57] ABSTRACT

The invention provides a filling assembly for dispensing quantities of liquid into containers wherein there is a dispensing head which registers with the top of the container to be filled, the container is raised to lift the discharge head, the liquid is dispensed into the container and the subsequent lowering of the discharge head when the container has been filled creates a partial vacuum effect in discharge passages through which the liquid is dispensed to prevent dripping or flowing of residual liquid into the container.

7 Claims, 2 Drawing Figures

FILLING HEAD ASSEMBLY FOR DISPENSING LIQUID

This invention relates to filling assemblies of flling machines for charging quantities of liquid into containers, and filling machines including such assemblies.

Filling machines are widely used in industry, because there are many liquids sold in quantities in individual containers. Such liquids include drinks, washing up liquids, oils, paints to name but a few.

In the filling of wide mouth containers such as cans, it is customery to use a filling assembly which has a plurality of discharge passage from which the liquid is discharged into the can (usually held sealingly to the assembly) at an angle so that the issuing liquid will impinge onto the inner wall of the can and run down the wall; this method of filling avoids frothing or excess frothing of the liquid in the can.

With the constant demand for ever higher rates of filling, the number and diameter of the said passages has tended, with the passage of time, to increase to such as extent that it is not uncommon for a filling assembly for filling cans with beer to have twelve passages each of a diameter of the order 8 mm. There is however a limiting factor on the size and number of the passages. Desirably, residual liquid should remain by capillary action in the passages after each charging operation, but if the passage diameter is too large, this will not happen or will happen only in some of the passages with the result that the amount of liquid in any container may lie within significantly wide tolerances, which means irregular filling from container to container, which in turn means that a filler usually has to overfill, resulting in either loss of profits or eventual loading of the price to the consumer. When one realises that a filling machine may have as many as 100 filling assemblies, and that in a brewery it may be filling cans with bear 24 hours a day, it will be appreciated that the loss or consumer charge loading which can result from overfilling can be quite considerable.

It is clearly desirably therefore that filling assemblies of liquid filling machines should operate to control more accurately the quantity of liquid discharged into each container at each operation of the or each filling assembly and the present invention aims at providing a filling assembly with this objective in view.

According to the present invention there is provided a filling assembly for a filling machine adapted to fill containers with liquid through the filling assembly, said assembly comprising a discharge head which is adapted to engage, fit over or otherwise co-operate with the mouth or open top of each container to be filled, said discharge head defining a plurality of discharge passages through which the liquid is discharged in being charged into the container, and communicating with a liquid chamber jointly defined by the discharge head and a discharge head guide, said discharge head being slidable relative to the guide, the assembly being adapted so that in use it is located above the open mouth or open top of a container to be filled, the discharge head and container are moved together so that the container mouth engages the discharge head which is displaced upwards relative to the guide, and after filling by charging the liquid through the chamber and the said passages, the container and head move apart which causes downward movement of the discharge head relative to the guide, which creates a partial vacuum effect in said chamber and thereby residual liquid in said passages is held in the passages or is drawn into the said chamber by virtue of the said partial vacuum effect.

Thus, it can be understood that in the use of the filling head according to the invention there is provided a positive control on the position of the residual liquid in the passages, and indeed also in the chamber.

Where the assembly is adapted for the filling of cans having open tops, the discharge head has a collar provided with a groove sealingly to receive the open can top, and a vent passage to allow venting of air as the can is being filled, and the said discharge passages are arranged so that the liquid issues therefrom to impinge on the can wall at a suitable angle having regard to the liquid being charged into the can.

Where the assembly is adapted for filling bottles, the discharge head may have a collar having a recess into which the bottle neck fits so that the shoulder of the bottle bears upon a sealing ring of the collar, the discharge head further including a poppet member having the discharge passages in the lower end thereof leading from a bore therein, said bore communicating at the top end with said chamber, and the member being slidably located in the collar, which latter has a vent for the venting of air rom the bottle when it is being filled with liquid.

The said poppet member is preferably spring located to a position in which the said discharge passages are blocked by the bore of the collar in which the poppet member slides, but is displaceable downwards by the guide when the discharge head is displaced upwards.

The guide preferably has a bore through which liquid is passed in being delivered to the discharge passages, flow through said bore normally being blocked by a one-way valve which opens by virtue of the pressure in the liquid being delivered to the discharge passages.

In a particularly effective adaptation, there may be a means whereby, before the discharge head and container separate after a filling operation, a blast of air is applied to the said chamber, thereby to discharge the residual liquid in the chamber and in the passages into the container; this additional step provides for very accurate filling of the container, because the residual liquid in the chamber the passages is positively discharged and in calculations, is included as part of the charge of liquid to be placed in the or each container. The air for supplying the said blast may be derived from a source which is also used for driving a main piston of the assembly which serves for the pumping of the quantity of liquid to be delivered to the or each container.

The filling assembly may also comprise conventional valving mechanism for controlling the flow of the liquid to the said chamber in charges in sequence with the operation at the filling assembly.

In a filling machine embodying assemblies according to the invention, these may be mounted so as to travel in an endless path, and in travelling in that path, each assembly and a container to be filled are brought into register, and move in register round the endless path; they are brought together; the container is filled through the assembly; the assembly and container are separated; the container is removed from the endless path and the assembly is subsequently brought into register with another container in relation to which the above cycle is repeated. All assemblies of the machine operate similarly.

Embodiments of the invention will now be described by way of example, with reference to the accompanying drawings wherein.

Figure 1:
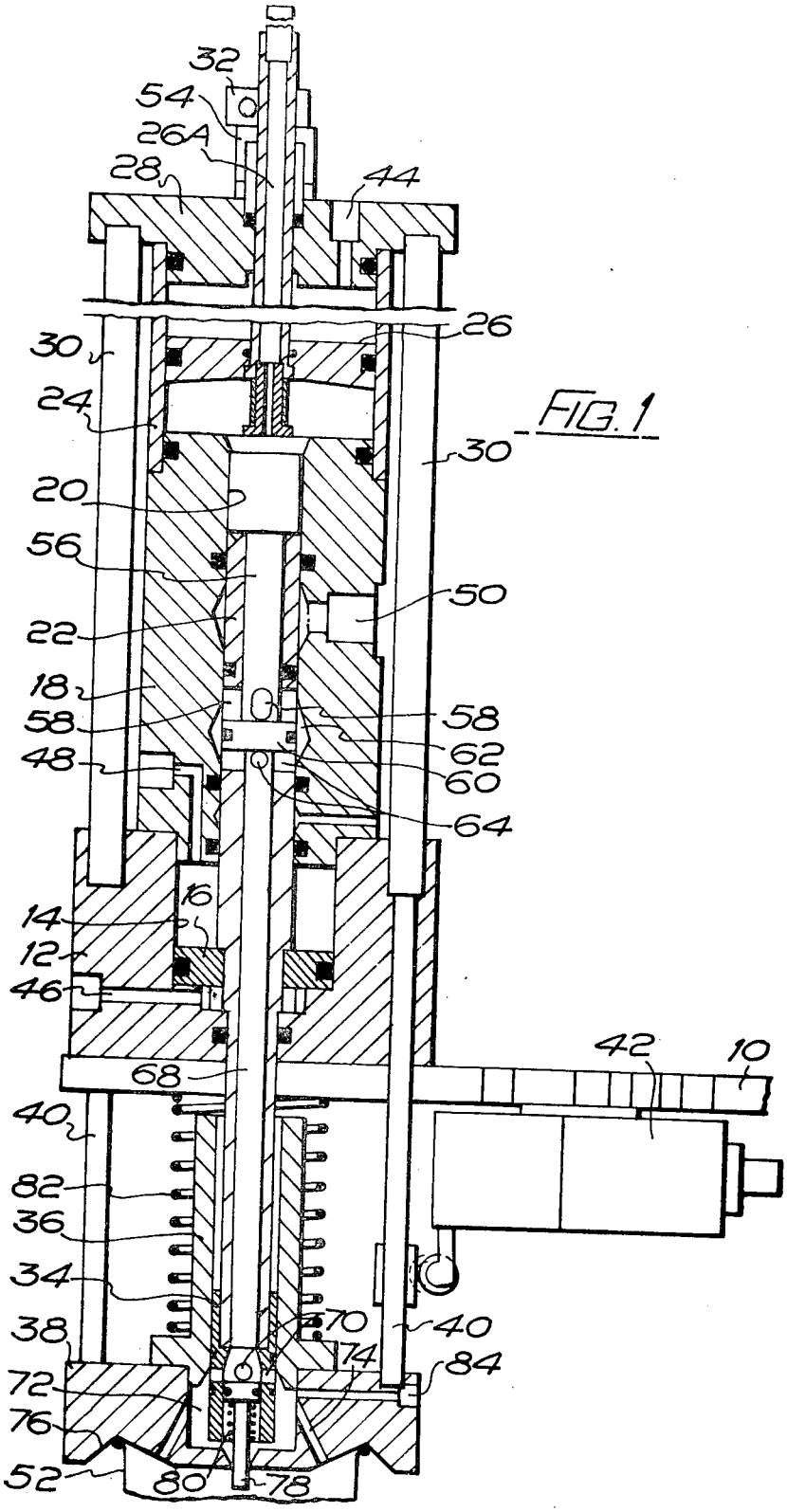
FIG. 1 shows a filling assembly according to one embodiment of the invention in sectional elevation.

The filling assembly shown in sectional elevation in FIG. 1 is for use in filling open top cans or wide mouth bottles and is mounted on a machine table 10 which in use rotates about a vertical axis. The table 10 is provided with a plurality of the said heads at radially arranged and equally spaced locations, and the description of the assembly shown therefore suffices for each of the other assemblies of the machine.

Fixed to the top of the table 10 is a cylindrical cylinder body 12 having a cylinder bore 14 in which is slidably located a valve displacement piston 16. Mounted on top of the body 12 is a valve body 18 of cylindrical form and having a bore 20 in which is slidably located a valve spindle or sleeve 22 which is adapted to be moved up and down to a limited extent by the piston 16.

On top of body 18 is provided a cylinder sleeve 24 in which is slidably located a main charging piston 26. The sleeve 24 is closed by a cap 28 and rigidifying rods 30 connect the cap 28 with the body 12. The body 12, body 18, sleeve 24, cap 28 and rods 30 are the parts of the head which do not move up and down in use and are firmly connected to the table 10.

A piston rod 26A of piston 26 projects slidably through the cap 28 and is provided with an adjustable stop member 32 whose position can be adjusted axially of the rod 26A in order to limit the extent of movement of piston 26 and thereby to limit the volume of liquid which is charged through the filling assembly into a container at any particular operation.

At the lower end of the valve spindle or sleeve 22 is provided a cylindrical guide body 34, on which is slidably mounted a discharge head comprising sleeve 36 which is slidable on the guide body 34, a collar 38 connected to the sleeve 36 so as to be movable therewith, and three guid rods 40 which are fast with the collar 38 and slidably locate in body 12 and also in bores in rods 30 as shown.

The assembly is also associated with a control valve 42 for controlling the supply of air under pressure to the top side of piston 26 through passage 44 in cap 28 on the one hand, and to the respective sides of piston 16 through passages 46 in body 12 and 48 in body 18 on the other hand. The assembly is provided with a plurality of O-ring seals which are illustrated in the drawing in conventional manner.

Inlet passage 50 in body 22 is for the supply of the charging liquid, which is under pressure, to the filling head and eventually to the container to be filled.

The filling assembly is shown in the position in which it engages the open mouth of a metal can 52, and the filling of the can has been completed in that the piston 26 is in the downwards position and the stop 32 sits on a limiting shoulder 54. Immediately prior to reaching the position shown, the piston 26 was moved from a position adjacent the cap 28 to the position shown by supply of air under pressure through the passage 44. As the piston thus moves downwardly, liquid to the underside of piston 26 is discharged through the bore 20 in body 18, through the top interior passage 56 in the valve spindle 22, through the radial passages 58 in the valve spinde 22 and round a blocking ring 60 of the valve spindle 22 by virtue of the position of the spindle 22 in relation to the enlarged groove 62 in the bore 20, then through the radial ports 64 at the top of the lower portion of the spindle 22, through the central bore 68 of the lower portion of spindle 22, and out through the bottom of spindle 22 and into radial passages 70 in the body 34, and then into chamber 72 which is defined between the collar unit and the guide body 34, and from the chamber 72, the liquid issues under pressure into the container 52 through the passages 74 in the collar 38 and lying so as to define a conical surface. In this example there are twelve passages 74, and it will be seen that they lead into a V-shaped groove 76 on the underside of the collar 38, which groove 76 is matched to the diameter of the container 52 to be filled so that the container top edge will lie in the base of the said groove 76. The inclination of the passages 74 ensures that the issuing liquid meets the container inner wall at the correct angle.

It is to be noticed that when the piston 26 first starts its stroke, the standing fluid in bore 68 of the sleeve 22 displaces a small control piston 78 against the action of compression spring 80 in the body 34 to the downward position shown, thereby clearing the radial passages 70.

If it is assumed that the assembly in the position shown in FIG. 1 has immediately terminated the filling step in that the piston 26 has just stopped its downward movement, the next movement which takes place is that the piston 78 moves upwardly under the action of the compressed spring 80, sealing off the interior of the bottom part of the sleeve 22 from the passages 70. The filling head and filled can are simultaneously moving in the endless path which is circular as it is defined by the periphery of the table 10 and, by virtue of a cam track, and container 52 starts to drop. As it drops, the collar unit also drops, because in the position shown in the drawings it is held in an upwards position against the compression of the spring 82. As the collar unit comprising the sleeve 36, collar 38 and pins 40 commence their downward movement, the effective volume of chamber 72 is increased, and a partial vacuum effect is created therein. This means that there is a sucking effect on any residual liquid in the passages 74 tending to pull that liquid back into the chamber 72. In other words uncontrolled dripping or spilling of the residual liquid into the container 52 is avoided. However, the sequence of operation of the valve 42 is such that air under pressure supplied through valve 42 is directed to a blasting passage 84 in the collar 38 and a blast of air is applied to the chamber 72 and out through the passages 74, whereby all residual liquid in the chamber and passages is blown into the container 52, and in fact forms part of the contents thereof. For the next charging operation therefore, the chamber 72 is completely empty, and this leads to establishment of accurate control of the metering of the charges of liquid into the respective containers. Initial tests on the arrangement shown in FIG. 1 have shown that it has a filling accuracy much greater than comparable known systems in that the filling can be maintained within a tolerance which is of the order of 1/6th of that of conventional equipment.

To return the filling assembly to the initial position completely, the valve stem 22 is next moved upwards in the body 18 by the application of air under pressure through passage 46 to the underside of piston 16, and the sleeve 22 moves upwards forcing liquid in the cylinder 18 above the sleeve 22 back into cylinder 24 and initiating the return movement of piston 26 overcoming the static friction thereof. This movement continues until the radial passages 58 register with the inlet 50 for the liquid, but the passages 64 are blocked from such inlet 50 by the ring 60 and its associated O-ring. The liquid under pressure now flows into the upper bore 56 in sleeve 22, and to the underside of the piston 26, and forces the piston 26 which has commenced movement, upwards until it abuts the underside of the cap 28, and the filling assembly is ready to perform the next filling operation. There is an advantage in this operation in that the static friction between the O-ring in piston 26 and the wall of cylinder 26 is overcome before fresh liquid is charged into the cylinder 24 through inlet 50. When a fresh container is presented for filling, air under pressure is directed through valve 42 to the top side of piston 16 by being passed through passage 48 in body 18, and the sleeve 22 is displaced downwardly to the position shown in which the source of liquid under pressure is blocked from communicating with the interior bore 56 of sleeve 22. The charging of the container now positioned under the assembly proceeds as described previously after the container is moved upwards into engagement with the collar 38, and the collar unit is displaced upwardly against the action of spring 82 to the position shown.

As stated above the filling assembly ss described and as shown in FIG. 1, has shown itself in practice to be extremely accurate, and the design of the assembly at the discharge head region also presents an additional advantage that the collar 38 can be replaced by another collar of a different size to suit different sized containers and indeed the filling head can be modified by removal of the collar 38 to adapt it for the filling of narrow necked containers such as bottles.

Figure 2:
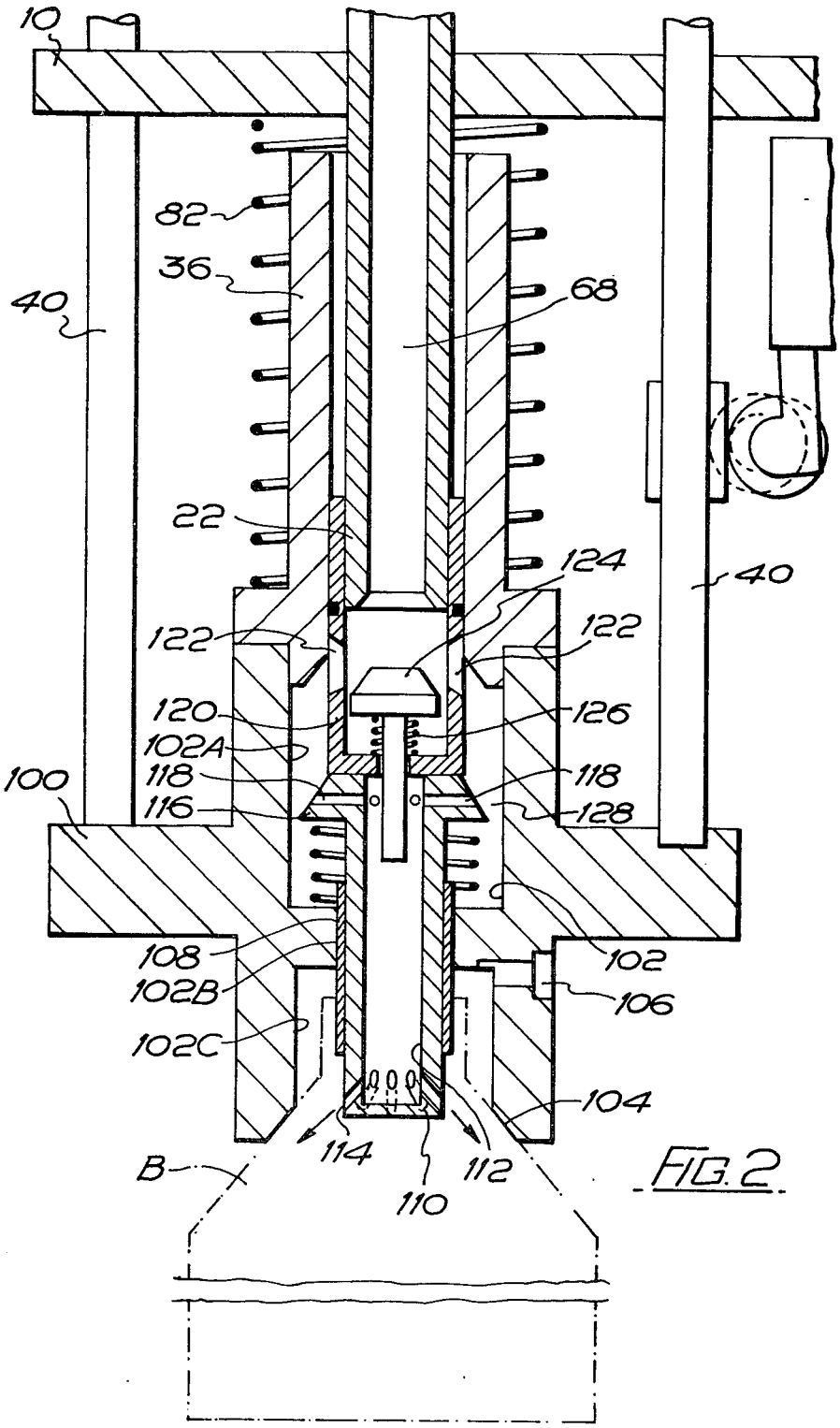
FIG. 2 shows, in sectional elevation part of a filling assembly according to a second embodiment of the invention the part not shown, as compared to FIG. 1, being identical to the corresponding part shown in FIG. 1.

In this regard, reference is now made to FIG. 2, which shows the operative part of the assembly shown in FIG. 1 modified to adapt it for the filling of bottles B as shown in FIG. 2.

Referring now to FIG. 2 in detail it will be seen that this figure shows the bottom end of the filling assembly. The figure shows the table 10, the guide rods 40, the valve spindle or sleeve 22, the sleeve 36 and the spring 82 which correspond to these components shown in FIG. 1. All of the components shown above the table 10 in FIG. 1 are also present in the FIG. 2 arrangement, but have been omitted in the interests of clarity.

The discharge head is further modified to adapt the filling assembly for the filling of bottles B, which have a tapered shoulder as shown located under the neck through which the containers are filled. The discharge head is provided with a collar 100 which is secured to the rods 40 and is provided with a central bore 102 of stepped configuration. That is to say, the bore has a relatively large diameter section 102A, an intermediate narrow diameter section 102B and a lower large diameter section 102C. The section 102C leads to a seat 104 of frusto-conical form which as shown engages the tapered shoulder of the bottle B during the filling operation. The section 102C in fact forms a recess for receiving the mouth of the filled bottle, and there is provided a vent passage 106 through which air may be vented when the bottle B is being filled with liquid. In the section 102B is a guide and sealing sleeve 108 in which is slidably located a poppet valve member 110. The stem of the valve member 110 has a bore 112 and at the bottom end a plurality of discharge passages 114 arranged at an angle to axis of the bore 112, such that the liquid issuing from the passage 114 impinges smoothly on the inside of the tapered portion of the bottle B as shown by the arrows.

The head 116 of the valve member 110 is provided with radial passages 118 leading from the bore 112, and the bore 112 also opens through the top of the head 116.

Screwed to the lower end of the valve spindle 22 is a control casing 120 having radial apertures 122 and a poppet control valve 124 therein. The valve 124 is urged by a spring 126 to seat against the lower end of the spindle 22 to seal the bore 68 of the spindle 22 when there is no delivery of liquid from the piston 26.

The arrangement shown in FIG. 2, operates as follows. In the position shown, the main piston 26 (FIG. 1) is in the course of its downward movement, and liquid is being discharged by being forced through bore 68 and out of apertures 122, the pressure in the liquid serving to urge the poppet valve 124 to the position shown, compressing spring 126. The liquid flows into the chamber 128 defined by bore section 102A then through the radial passages 118, into the bore 112 of the member 110 and eventually out of the inclined passages 114 into the bottle B. Air displaced from the bottle flows to atmosphere through vent 106. At the end of the downward movement of the piston 26 (FIG. 1) the pressure in the fluid maintaining the valve 124 displaced in control casing 120 is lost and that valve lifts under the action of spring 126 sealing the lower end of stem 22. In the next stage of operation, the bottle B lowers from the discharge head and the discharge head initially follows the bottle movement by virtue of the spring 82 forcing same downwards. As the spindle 22 is positionally fixed, as the discharge head and in particular the collar 100 and sleeve 36 move downwards relative to the control member 120 there is created in the chamber 128 a partial vacuum effect and by this effect residual liquid in the passages 114 is retained therein or is sucked back into the bore 112 ensuring accurate filling of the bottle B. Eventually, the poppet member 110 moves into the sleeve 108, sealing the discharge passages 114. Next, the container B moves clear of the discharge head for removal from the machine.

The arrangement of FIG. 2 operates satisfactorily at a very high frequency and a machine with 20 filling assemblies can fill as many as 9,000 bottles per hour which is extremely high. Furthermore, by creating the said partial vacuum effect one can use much larger bore sizes in the passages 114 which permits a more rapid filling.

However, this applies to both embodiments, at the end of a charging operation and before fresh incoming liquid is supplied to the cylinder 24 (FIG. 1) through inlet passage 50 (FIG. 1) the piston 26 is already moving in a retraction direction by virtue of the fact that the sleeve 22 is being displaced by or under pressure applied to the inside of piston 16. The cylinder therefore is in fact pre-charged before the inflow through passage 50 commences and that inflow does not therefore have to overcome the static friction (which is high) in the region of the O-ring in piston 26.

The filling assembly described may have the majority of its components fabricated in plastics material if desired.

I claim:

1. A filling assembly for a filling machine adapted to fill containers with liquid through the filling assembly, comprising:

(a) a discharge head guide, (b) a discharge head adapted to engage, fit over, or otherwise cooperate with the mouth or open top of each container to be filled, (c) said discharge head slidably cooperating with said discharge head guide to define an expansible liquid chamber, (d) a plurality of discharge passages in said discharge head in fluid communication with said liquid chamber for discharging liquid from said chamber into the open top of a container below and engaging said discharge head in an operative position, (e) said liquid chamber being adapted to be contracted by the upward movement of said discharge head and container in said operative position, and to be expanded by the downward movement of said discharge head and container in said operative position, (f) means for supplying liquid to said chamber for discharging through said discharge passages before said chamber is expanded, (g) the expansion of said chamber creating a partial vacuum effect in said chamber, which effect retains residual liquid in said discharge passages or draws said residual liquid into said chamber.

2. The invention according to claim 1 in which the containers to be filled by said filling assembly are cans having open tops, said discharge head comprising a collar having a groove to sealingly receive the open top of a can, and a vent passage in said discharge head to vent air from said can as said can is being filled.

3. The invention according to claim 2 in which said discharge passages are arranged in said discharge head at predetermined angles so that liquid discharged from said passages impines on the wall of said can.

4. The invention according to claim 1 in which the containers to be filled by said filling assembly are bottles, said discharge head comprising a collar having a recess for receiving the upper end of the bottle and an annular seat for bearing against the bottle in filling position and in sealing engagement, a vent in said collar for venting air from the bottle while it is being filled with liquid.

5. The invention according to claim 4 in which said discharge head comprises a poppet member having an upper end, a lower end, and a bore therein, said bore communicating through said top end with said liquid chamber, said discharge passages being in said lower end and in fluid communication with said bore, said poppet member being slidably mounted within said collar.

6. The invention according to claim 5 in which said collar includes a collar bore slidably receiving said poppet member, and spring means biasing said poppet member to a position in which said discharge passages are closed by said collar bore, said poppet member being displacable downward by said discharge head guide when said discharge head is moved upward.

7. The invention according to claim 1 in which said discharge head guide includes a guide bore in fluid communication between said means for supplying liquid and said discharge passages, a one-way valve normally blocking the flow of liquid through said guide bore, but being biased to an open position by the pressure of the liquid flowing froms said means for supplying liquid to said discharge passages through said guide bore.

* * * * *